US010202173B2

(12) United States Patent
Farber et al.

(10) Patent No.: US 10,202,173 B2
(45) Date of Patent: Feb. 12, 2019

(54) MAST SYSTEM AND METHOD

(71) Applicant: Elta Systems Ltd., Ashdod (IL)

(72) Inventors: Amit Farber, Rosh Ha'ayin (IL); Ehud Erell, Herzliya (IL)

(73) Assignee: Elta Systems Ltd., Ashdod (IL)

( * ) Notice: Subject to any disclaimer, the term of this patent is extended or adjusted under 35 U.S.C. 154(b) by 0 days.

(21) Appl. No.: 15/026,118

(22) PCT Filed: Sep. 29, 2014

(86) PCT No.: PCT/IL2014/050859
§ 371 (c)(1),
(2) Date: Mar. 30, 2016

(87) PCT Pub. No.: WO2015/049682
PCT Pub. Date: Apr. 9, 2015

(65) Prior Publication Data

US 2016/0236753 A1 Aug. 18, 2016

(30) Foreign Application Priority Data

Oct. 2, 2013 (IL) ..... 228688

(51) Int. Cl.
*B63G 8/38* (2006.01)
*B63B 15/00* (2006.01)

(52) U.S. Cl.
CPC ..... *B63B 15/00* (2013.01); *B63G 8/38* (2013.01); *B63B 2015/0041* (2013.01)

(58) Field of Classification Search
CPC ... B63G 8/36; B63G 8/38; B63G 8/04; B63G 8/06
See application file for complete search history.

(56) References Cited

U.S. PATENT DOCUMENTS 4,533,945 A * 8/1985 Lauvray ..... B63G 8/38 340/850
4,848,886 A * 7/1989 Pratt ..... B63G 8/38 114/340

(Continued)

FOREIGN PATENT DOCUMENTS

DE 3716536 A1 * 11/1988 ..... B63G 8/04
DE 10 2007 005460 B3 4/2008

(Continued)

OTHER PUBLICATIONS

Supplementary European Search Report for PCT/IL2014/050859 (dated May 19, 2017).

*Primary Examiner* — Andrew Polay
(74) *Attorney, Agent, or Firm* — Mintz Levin Cohn Ferris Glovsky and Popeo, P.C.; Steven M. Jensen

(57) ABSTRACT

Mast systems are provided for use with an underwater vehicle. In one example the mast system includes a support base, a mast arm and a mast payload bay. The support base defines a base axis. The mast arm defines a longitudinal axis, and has a free longitudinal mast end and a mast mounting portion longitudinally spaced from the mast end. The mast payload bay is provided at the mast end, and is configured for supporting a payload. The mast arm is mounted to the support base via the mast mounting portion, and the mast arm is selectively deployable with respect to the support base at least between a retracted configuration, in which the mast end is at a first spacing with respect to the mast mounting portion, and an extended configuration, in which the mast end is at a second spacing with respect to the mast mounting portion, the second spacing being greater than the first spacing. The mast system is configured for operating in a marine environment.

18 Claims, 9 Drawing Sheets

(56) References Cited

U.S. PATENT DOCUMENTS

| | | | | |
|---|---|---|---|---|
| 2005/0219697 | A1 | 10/2005 | Weisser et al. | |
| 2007/0215030 | A1 | 9/2007 | Scharf et al. | |
| 2012/0315811 | A1* | 12/2012 | Sancoff ..... | B63G 8/001 440/3 |

FOREIGN PATENT DOCUMENTS

| | | | |
|---|---|---|---|
| EP | 0364341 | A1 | 4/1990 |
| EP | 1162137 | A2 | 12/2001 |
| EP | 2540614 | A1 | 1/2013 |
| FR | 2985497 | A1 | 7/2013 |
| GB | 191201335 | A | 1/1913 |
| GB | 191511143 | A | 7/1916 |
| GB | 2012217 | A | 7/1979 |

* cited by examiner

MAST SYSTEM AND METHOD

TECHNOLOGICAL FIELD

The presently disclosed subject matter relates to systems and methods for underwater vehicles.

BACKGROUND

A variety of systems and methods for underwater vehicles are known.

Some types of underwater vehicles, for example some submarines, include a vertical structure amid-ships, commonly referred to as a "sail" or "fin", which houses retractable periscopes and the like, and allow the periscope to break surface while the underwater vehicle including the "sail" are still submerged at a short depth from the sea surface.

GENERAL DESCRIPTION

According to at least an aspect of the presently disclosed subject matter, there is provided a mast system for use with an underwater vehicle, comprising:

a support base defining a base axis;

a mast arm defining a longitudinal axis, and comprising a free longitudinal mast end and a mast mounting portion longitudinally spaced from said mast end;

a mast payload bay provided at said mast end, configured for supporting a payload therein;

the mast arm being mounted to the support base via said mast mounting portion, and the mast arm being selectively deployable with respect to the support base at least between a retracted configuration, in which said mast end is at a first spacing with respect to said mast mounting portion, and an extended configuration, in which said mast end is at a second spacing with respect to said mast mounting portion, wherein said second spacing is greater than said first spacing, wherein the mast system is configured for operating in a marine environment.

In at least one example the mast system further comprises a pressure vessel, wherein said payload bay is selectively reversibly retractable into said pressure vessel to enable isolating a payload bay pressure from an ambient pressure outside of said pressure vessel.

Additionally or alternatively, for example, said mast arm comprises a plurality of longitudinally movable nested telescopic sections between said mast end and said mast mounting portion.

Additionally or alternatively, for example, the mast system comprises a first drive unit for selectively driving said mast end longitudinally away from said mast mounting to provide said extended configuration, and for selectively driving said mast end longitudinally towards said mast mounting to provide said retracted configuration.

Additionally or alternatively, for example, said mast arm is pivotably mounted to said support base about a pivot axis via said mast mounting portion, said pivot axis being orthogonal to said longitudinal axis. For example, said mast arm is reversibly pivotably movable with respect to said support base about said pivot axis between a stowed position and a deployed position. For example, the mast system comprises a second drive unit for selectively pivoting said mast arm about said pivot axis from said stowed position to said deployed position, and for selectively pivoting said mast arm about said pivot axis from said deployed position to said stowed position. Additionally or alternatively, for example, in said stowed position, said mast arm is in said retracted configuration, and wherein in said deployed position said mast arm is selectively deployable to said extended configuration. Additionally or alternatively, for example, in said stowed position, said longitudinal axis is parallel to said base axis, and wherein in said deployed position said longitudinal axis is orthogonal to said base axis. Additionally or alternatively, for example, said pivot axis is orthogonal to said base axis.

Additionally or alternatively, for example, said payload bay is pivotable about said longitudinal axis, at least in said extended configuration.

Additionally or alternatively, for example, said pressure vessel comprises a closable payload housing, and wherein said payload bay is selectively reversibly retractable into said payload housing between a housed configuration and an exposed configuration.

Additionally or alternatively, for example, in said housed configuration, fluid communication is prevented between said payload bay and an outside of said mast system.

Additionally or alternatively, for example, said pressure vessel comprises a bulkhead arrangement, wherein in said housed configuration said payload housing is configured for sealing with respect to said bulkhead arrangement to prevent fluid communication between said payload bay and an outside of said mast system, and wherein in said exposed configuration said payload housing is configured for being unsealed with respect to said bulkhead arrangement and to provide fluid communication between said payload bay and an outside of said mast system. For example, said bulkhead arrangement is fixed to the payload bay.

For example, said bulkhead arrangement comprises an outer facing bulkhead at an outer longitudinal end of said payload bay, said bulkhead configured for preventing fluid communication between said payload bay and an outside of said mast system in a longitudinal outward direction through said bulkhead, said bulkhead further comprising a bulkhead sealing perimeter configured for sealing with respect to said payload housing in said housed configuration. For example, the mast system further comprises an auxiliary payload bay projects outwardly from said bulkhead, said auxiliary payload bay being in communication with said payload bay.

For example, said payload housing comprises a chamber configured for accommodating therein said payload bay in said housed configuration, said chamber having a chamber opening configured to allow said payload bay to be selectively and reversibly retracted with respect to said payload housing, said opening comprising a housing sealing perimeter for reversibly sealing with respect to said bulkhead sealing perimeter in said housed configuration. For example, said bulkhead is disc-shaped and wherein said payload housing comprises a lateral peripheral wall having a payload housing axis parallel to said longitudinal axis, and defining said chamber opening and a closed end at respective opposite longitudinal ends of said lateral peripheral wall. For example, said lateral peripheral wall is a tubular wall.

Additionally or alternatively, for example, the mast system comprises an inflatable seal arrangement for selectively sealing and for selectively unsealing said bulkhead with respect to said payload housing.

Additionally or alternatively, for example, said pressure vessel is configured for enabling the payload bay to have a said payload bay pressure isolated from an outside of said mast system, in said housed configuration.

Additionally or alternatively, for example, said pressure vessel maintains said payload bay pressure constant in said housed configuration.

Additionally or alternatively, for example, said pressure vessel operates to maintain said payload bay pressure at below a threshold value, in said housed configuration. For example, said threshold value is a gauge pressure of 1 bar or less. For example, said threshold value is a gauge pressure of 1 bar or less, while an outside ambient pressure is under a gauge pressure of more than 5 bar.

Additionally or alternatively, for example, said payload bay is in said housed configuration concurrent with said mast arm being in said retracted configuration.

Additionally or alternatively, for example, said payload bay is in said exposed configuration at least concurrent with said mast arm being in said extended configuration.

Additionally or alternatively, for example, said payload housing is fixedly mounted to said mast mounting portion and is pivotably movable with said mast mounting portion about said pivot axis.

Additionally or alternatively, for example, said mast arm comprises a lumen.

Additionally or alternatively, for example, the mast system, further comprises a plurality of cables providing at least one of power transmission and data transmission between said payload bay and an outside of said mast system. For example, the mast system further comprises a cable management system, configured to enabling the cables to remain anchored to the payload bay irrespective of whether said mast arm is in said stowed position or in said deployed position, and irrespective of whether said mast arm is in said retracted configuration or in said extended configuration. For example, said cable management system is comprised in said support base. For example said cables are routed through a center of said mast arm.

Additionally or alternatively, for example, in said deployed position, said longitudinal axis is vertical.

Additionally or alternatively, for example, in said stowed position, said longitudinal axis is horizontal.

Additionally or alternatively, for example, in said retracted configuration and said stowed position, said mast system fits into a predetermined geometrical envelope. For example, in said extended configuration and said deployed position, said payload bay extends from said geometrical envelope by more than 2 m. For example said extended configuration and said deployed position, said payload bay extends from said geometrical envelope by at least 3 m. For example said geometrical envelope conforms to, or is configured for being mounted within, a hull compartment of an underwater vehicle. For example, said mast system in said extended configuration and said deployed position comprises a center of gravity that is below a centerline of the underwater vehicle.

For example, when installed in the underwater vehicle, the mast system is configured to optimize performance of the underwater vehicle when the mast arm is fully stowed, and for minimizing exposure of the vessel when the mast arm is fully deployed.

According to an aspect of the presently disclose subject matter there is provided a mast system for use with an underwater vehicle, comprising:

a support base defining a base axis;

a mast arm defining a longitudinal axis, and comprising a free longitudinal mast end and a mast mounting portion longitudinally spaced from said mast end;

a mast payload bay provided at said mast end, configured for supporting a payload therein;

the mast arm being mounted to the support base via said mast mounting portion, and the mast arm being selectively deployable with respect to the support base between a retracted configuration, in which said mast end is at a first spacing with respect to said mast mounting portion, and an extended configuration, in which said mast end is at a second spacing with respect to said mast mounting portion, wherein said second spacing is greater than said first spacing, wherein said payload bay is selectively reversibly retractable into said pressure vessel to enable isolating a payload bay pressure from an ambient pressure outside of said pressure vessel.

For example, the mast system is configured for operating in a marine environment.

For example, when installed in the underwater vehicle, the mast system is configured to optimize performance of the underwater vehicle when the mast arm is fully stowed, and for minimizing exposure of the vessel when the mast arm is fully deployed.

According to an aspect of the presently disclose subject matter there is also provided an underwater vehicle comprising the mast system as defined herein, in particular as defined above. For example, said underwater vehicle is an unmanned underwater vehicle.

According to an aspect of the presently disclose subject matter there is also provided a method for selectively exposing a payload to an atmospheric environment, comprising (a) providing an underwater vehicle comprising the mast system as defined herein, in particular as defined above;

(b) operating the mast system to deploy the mast arm at least to the extended configuration while a remainder of the mast system is submerged.

BRIEF DESCRIPTION OF THE DRAWINGS

In order to better understand the subject matter that is disclosed herein and to exemplify how it may be carried out in practice, examples will now be described, by way of non-limiting example only, with reference to the accompanying drawings, in which:

FIG. 7(*a*) shows a detail view of part of the example of FIG. 7.

DETAILED DESCRIPTION

Referring to FIGS. 1 to 7, a mast system, according to a first example of the presently disclosed subject matter, generally designated 100, comprises a support base 200, a support an 300, and a payload bay 400. Herein, the mast system 100 can be interchangeably referred to as a mast assembly.

As will become clearer hereinbelow, in this example, the mast system 100 is configured for selectively retracting and selectively extracting the payload bay with respect to a pressure vessel, such that when retracted therein, the payload bay is pressure-isolated for the outside of the mast system, in particular from the outside of the pressure vessel.

The mast system 100 at least in this example is configured for operating in a marine environment, for example the sea, and at least in this example the mast system 100 is configured for operating at sea depths of more than 50 m.

The term "sea" also refers to, and is used herein interchangeably with, other bodies of water, for example ocean, rivers, lakes, reservoirs, etc.

The mast system 100 at least in this example is configured for operating within a predetermined range of air temperatures, and at least in this example this air temperature range is between −20° C. to +50° C., though in alternative variations of this example the air temperature range can be different.

The mast system 100 at least in this example is configured for operating within a predetermined range of sea temperatures, and at least in this example this sea temperature range has an upper limit of +32° C., though in alternative variations of this example the sea temperature range can be different.

Figure 1:
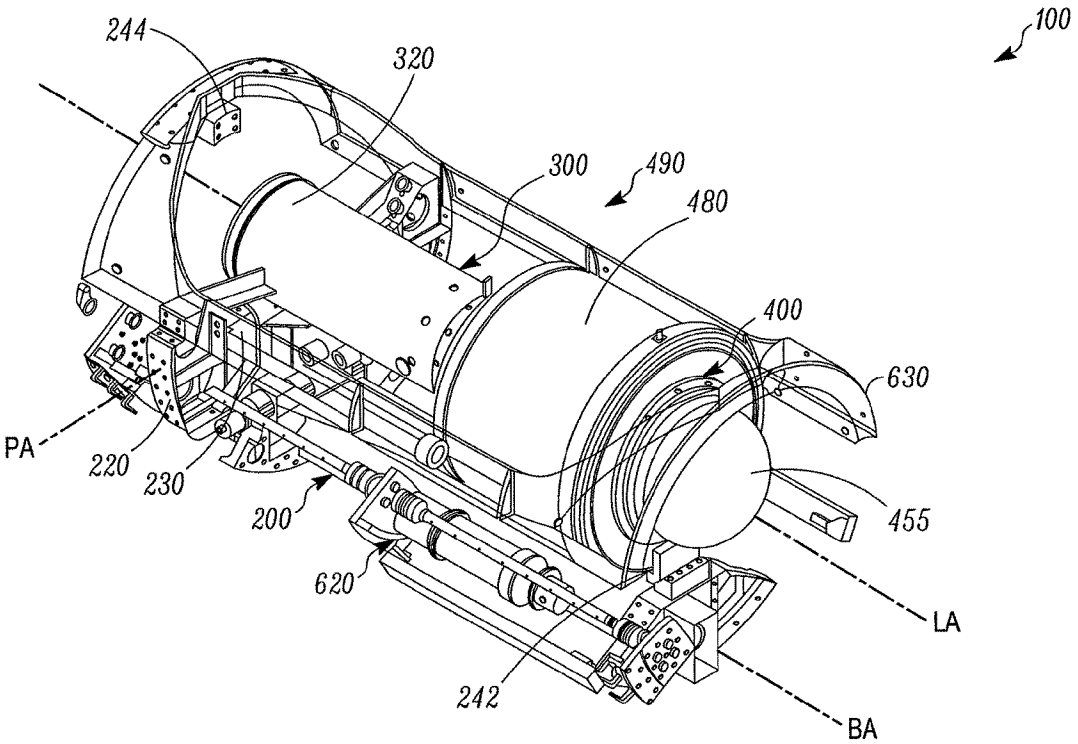
FIG. 1 illustrates in isometric view a first example of the mast system, in which the mast arm is in the retracted configuration and in the stowed position.
Figure 8:
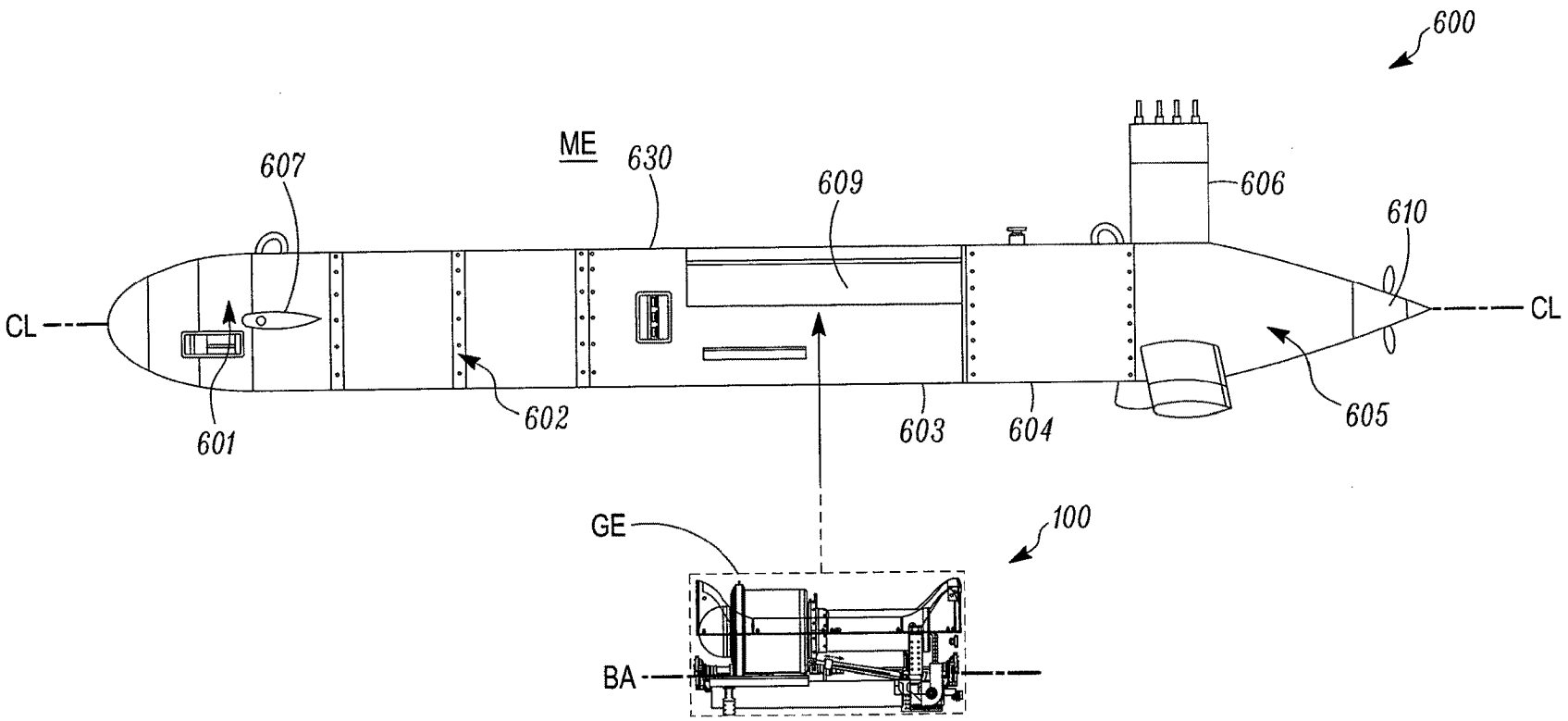
FIG. 8 illustrates in side view an example of an underwater vehicle in which the first example of the mast system is accommodated in a hull compartment therein.

Furthermore, at least in this example, the mast system 100 is configured for use with an underwater vehicle. Referring also to FIG. 8, an example of such an underwater vehicle, generally designated 600 (also referred to interchangeably herein as a submersible vehicle, or as a submersible vessel, or as an underwater vessel) is configured for operating when submerged, and can take many different forms. In this example, the underwater vehicle 600 is unmanned and self propelled, comprising a suitable underwater propulsion system 610, and a suitable underwater maneuvering system in the form of vanes 606, 607. The underwater vehicle 600 comprises a pressure hull 602, in this example torpedo-shaped including a nose section 601, a tail section 605, and an intermediate section 630. The intermediate section 630 of the hull 602 includes a hull compartment 603, configured for accommodating therein the mast system 100. The underwater vehicle 600 further comprises hull doors 609 on the upper side of the pressure hull 602. The hull doors 609 are configured for selectively opening, at least when the underwater vehicle 600 is submerged, exposing the hull compartment 603, and thus exposing the mast system 100, to the surrounding marine environment ME. Referring to FIG. 1, a powered hull door drive mechanism 620 is provided for selectively opening and for selectively closing the hull doors 609.

Referring again to FIGS. 1 to 3 in particular, the support base 200 is configured for mounting and securing the system 100 to the underwater vehicle 600, in particular the hull compartment 603, and comprises support brackets 220 that affix the mast system 100 to the hull compartment 603. For convenience, a base axis BA can be defined for the support base 200, the base axis BA passing near to the geometric center of the support brackets 220, and being parallel to the centerline CL (see FIG. 8) of the underwater vehicle 600.

Referring again to FIGS. 1 to 4 in particular, the mast an 300 is elongate, defining a longitudinal axis LA, and comprises a free longitudinal mast end 310 and a mast mounting portion 320.

Figure 3:
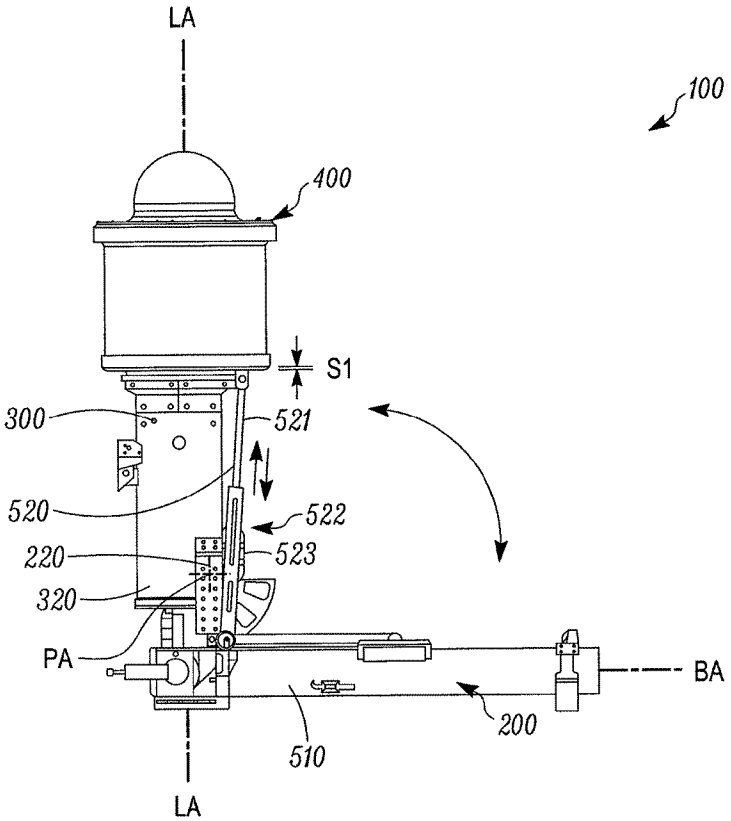
FIG. 3 illustrates in side view the first example of the mast system, in which the mast arm is in the retracted configuration and in the deployed position.
Figure 4:
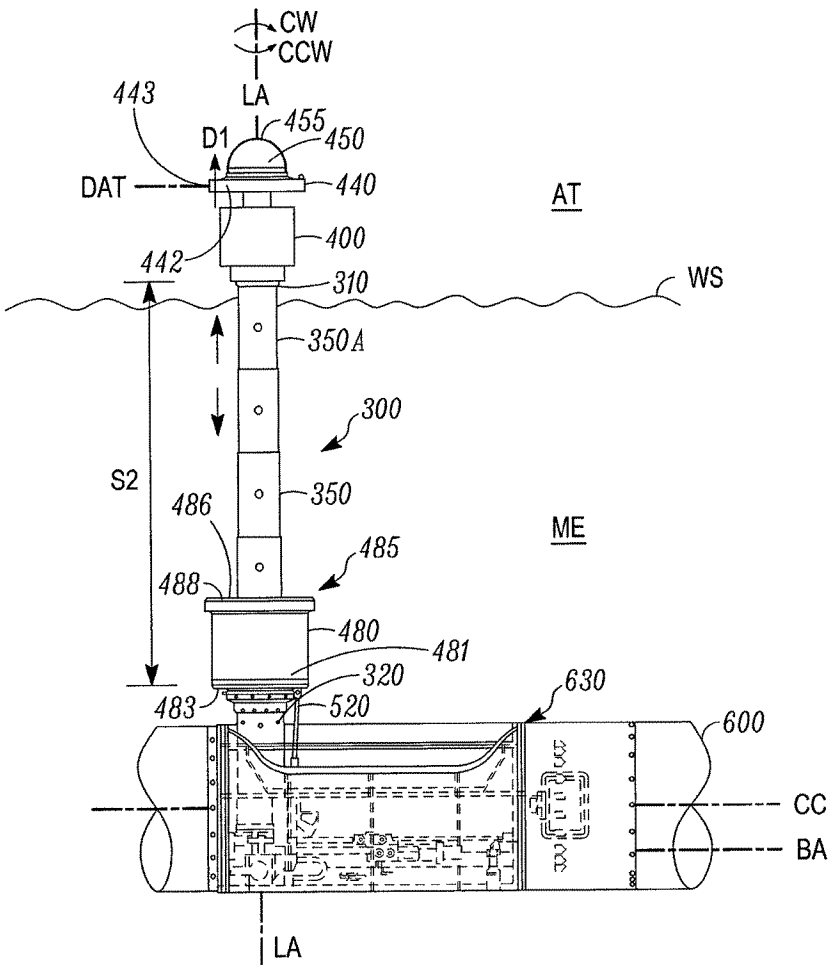
FIG. 4 illustrates in side view the first example of the mast system, in which the mast arm is in the extended configuration and in the deployed position.
Figure 5A:
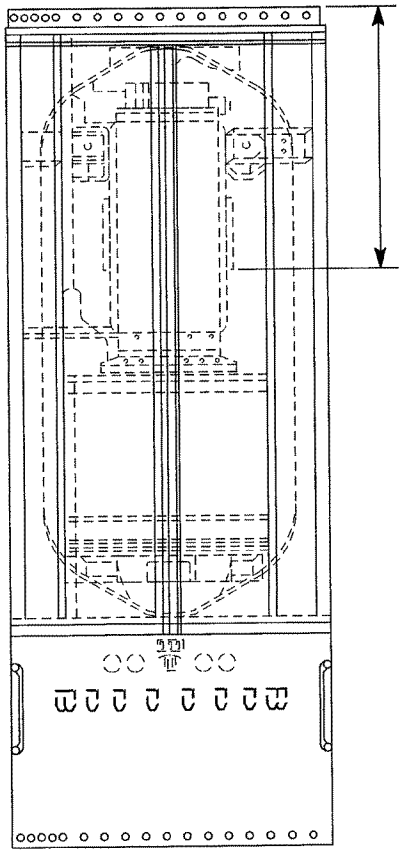
FIG. 5(*a*) and FIG. 5(*b*) illustrate, in top view and side view respectively, the first example of the mast system accommodated within a hull compartment, in which the mast arm is in the retracted configuration and in the stowed position within the hull compartment.
Figure 5B:
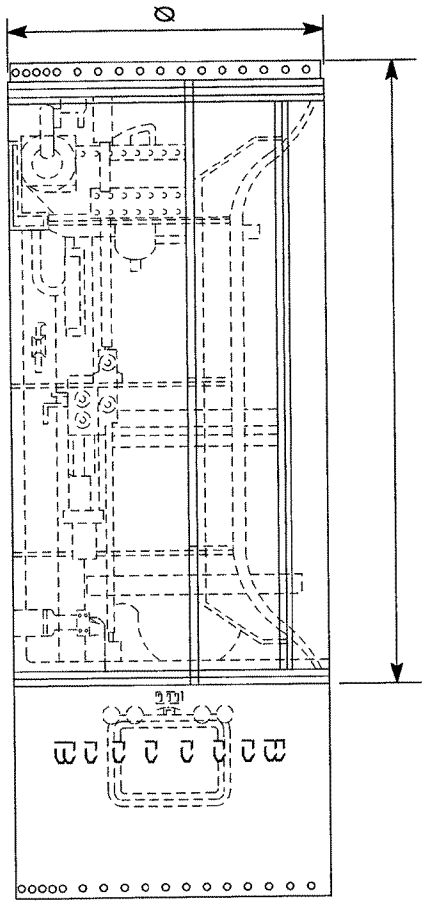

The mast arm 300 is mounted to the support base 200 via the mast mounting portion 320, and the mast arm 300 is selectively deployable (in particular at least extendible) with respect to the support base 200 between a retracted configuration (see FIGS. 1, 2 and 3), and an extended configuration (see FIG. 4). The mounting portion 320 is longitudinally spaced from the mast end 310, and this spacing varies according to the configuration of the mast arm 300, i.e., between the retracted configuration and the extended configuration.

As best seen in FIG. 4, the mast payload bay 400 is provided at the mast end 310. The mast payload bay 400 is configured for supporting and/or accommodating a payload (not shown) therein, and thus comprises one or more payload chambers and is optionally in communication with an auxiliary payload bay 450, best seen in FIG. 7. As will become clearer herein, and referring to FIG. 4, the payload bay 400 (as well as the auxiliary payload bay 450) is configured to carry therein any desired payload, for example in the form of devices and/or materials and/or systems, that can be fitted within the payload bay 400 (and/or in the auxiliary payload bay 450) and that it is desired to expose to the atmosphere AT at least while the underwater vehicle 600 is submerged in the marine environment ME, albeit in this example submerged in the marine environment ME only a few meters below the water surface WA. For example, one such auxiliary payload bay 450 is in fluid communication with the payload bay 400. In this example, the auxiliary payload bay 450 is hemispherically shaped, and capped by a hemispherical shell 455.

Figure 6:
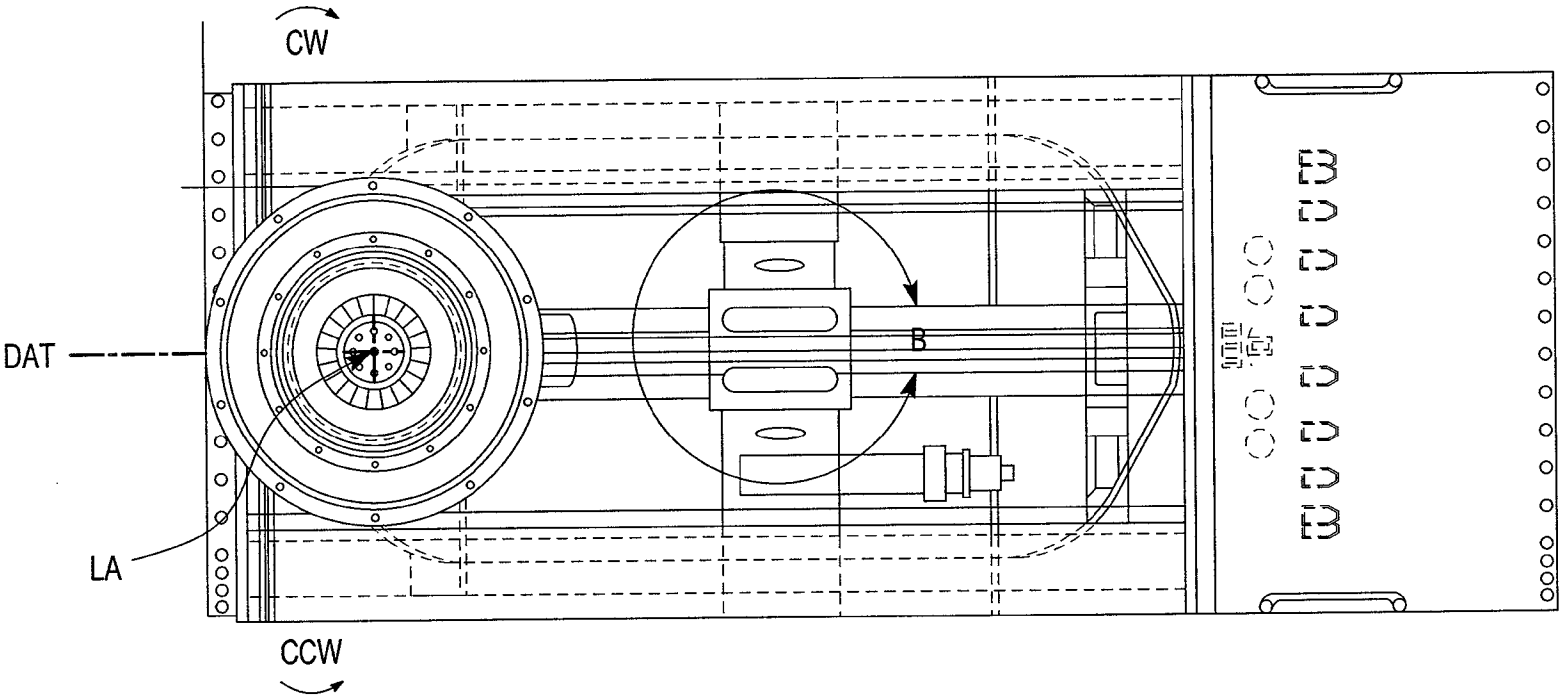
FIG. 6 illustrates, in top view, the first example of the mast system of FIGS. 5(*a*) and 5(*b*), in which the mast arm is in the deployed position with respect to the hull compartment.
Figure 7:
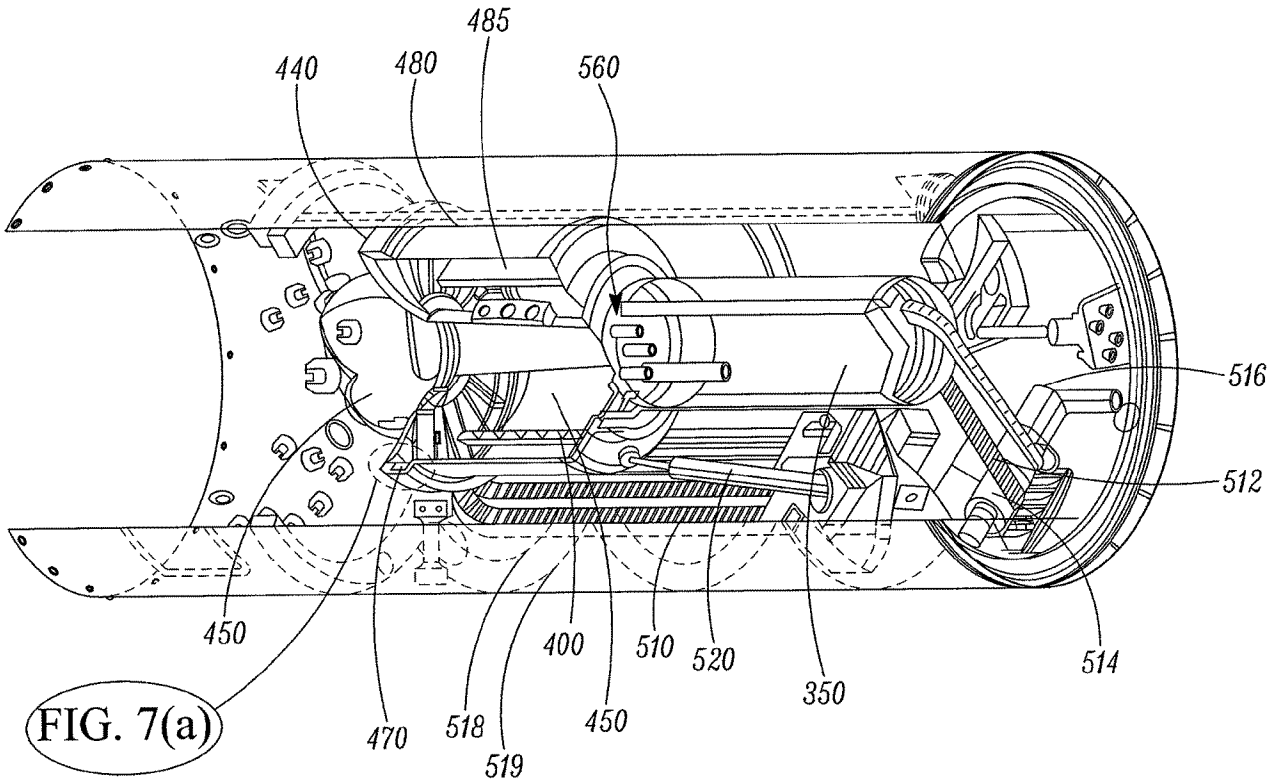
FIG. 7 illustrates in cutaway isometric cross-sectional view the first example of the mast system accommodated within a hull compartment, in which the mast arm is in the retracted configuration and in the stowed position.
Figure 7A:
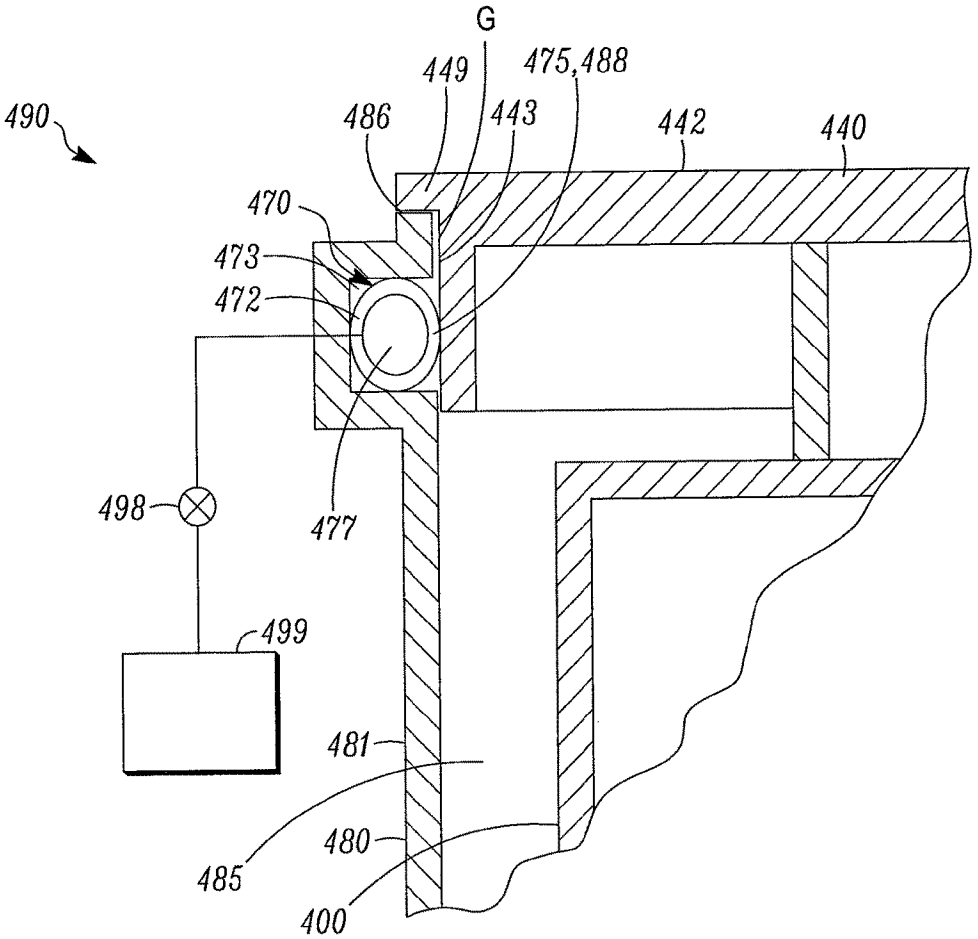

In this example, the payload bay 400 is pivotable about the longitudinal axis LA, at least when the mast arm 300 is in the deployed position and in the extended configuration. This confers a panning capability to the payload bay 400 in azimuth. Referring to FIGS. 4 and 6, such pivoting can comprise, for example, a clockwise rotation CW and/or a counterclockwise rotation CCW, with respect to an angular datum DAT, through a maximum permitted angular range. For example, such an angular range can be ±175° with respect to angular datum DAT. For example, angular datum DAT can be parallel to the centerline CL of the underwater vehicle 600 or to the base axis BA. Referring to FIG. 7, a mast arm drive unit 560, for example in the form of a panning mechanism, is provided to selectively drive pivoting of the payload bay 400 about the longitudinal axis LA. In this example, the mast arm drive unit 560 is configured for pivoting the payload bay 400 about the longitudinal axis LA at a desired angular speed, for example 4 rpm. In this example, the mast arm drive unit 560 is also configured for providing rotational position feedback regarding the angular position of the payload bay 400 about the longitudinal axis LA with respect to the angular datum DAT. For example, such rotational position feedback can have an accuracy of at least 0.1°.

In alternative variations of this example, the payload bay 400 is additionally or alternatively pivotable about a tilt axis orthogonal to the longitudinal axis LA, at least when the mast arm 300 is in the deployed position and in the extended configuration, conferring a full or partial tilt capability to the payload bay 400 in elevation.

Referring to FIG. 3, in the retracted configuration, the mast end is at a first spacing S1 with respect to the mast mounting portion 320. Referring to FIG. 4, in the extended configuration, the mast end 310 is at a second spacing S2 with respect to the mast mounting portion 320. Clearly, the second spacing S2 is greater than the first spacing S1.

As best seen in FIGS. 4 and 7, the mast arm 300 comprises a plurality of longitudinally movable nested telescopic sections 350, provided between the mast end 310 and the mast mounting portion 320. The telescopic sections 350 are, in this example, generally tubular with circular transverse cross-section, although in alternative variations of this example the respective telescopic elements can have other cross-sections, for example rectangular, in which free relative rotation between the telescopic elements about the longitudinal axis LA is naturally prevented.

Thus, the mast arm 300 comprises a lumen 380, running through the center of the telescopic sections 350.

Referring in particular to FIG. 1, in this example the mast arm 300 is pivotably mounted to the support base 200 about a pivot axis PA via the mast mounting portion 320. In particular, the mast mounting portion 320 is pivotably mounted to the support brackets 220 with respect to the pivot axis PA, via bearing arrangement 230. The pivot axis PA is orthogonal to the longitudinal axis LA. The mast arm 300 is pivotably movable with respect to the support base 200 about the pivot axis PA within an angular range. In this example, the angular range is 90°, allows the arm 300 to be selectively pivoted about the pivot axis PA between a stowed position, illustrated in FIGS. 1 and 2, and a deployed position, illustrated in FIGS. 3 and 4. A first angular stop 242 is provided on the support base 200 to define the angular position of the arm 300 in the stowed position, and a second angular stop 244 is provided on the support base 200 to define the angular position of the arm 300 in the deployed position.

In alternative variations of this example and in other examples, the mast arm is fixedly mounted to the support base with the longitudinal axis LA in a vertical orientation, and thus the respective mast arm is deployed and stowed only by extending and retracting, respectively, the mast arm.

Figure 2:
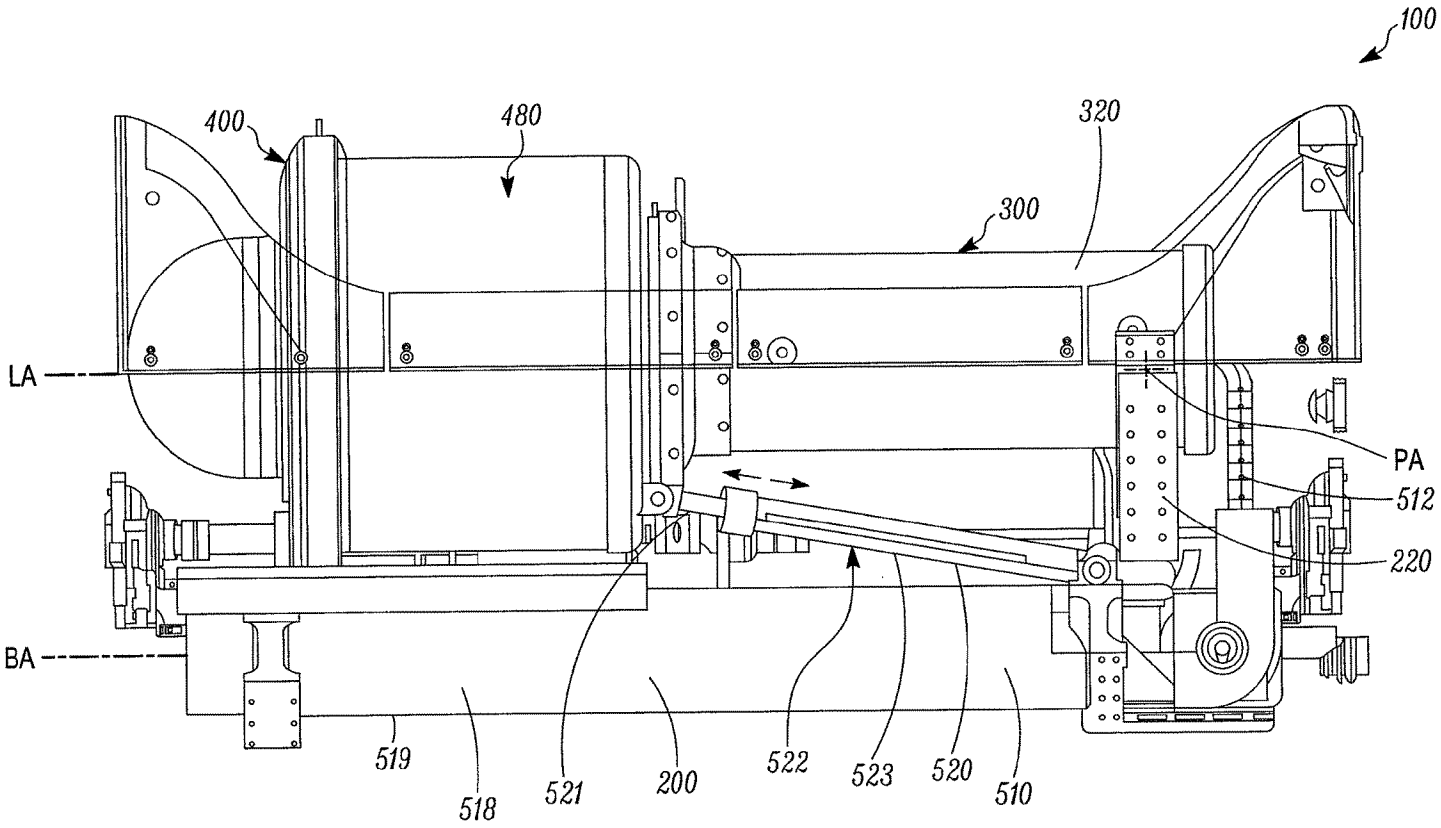
FIG. 2 illustrates in side view the first example of the mast system, in which the mast arm is in the retracted configuration and in the stowed position.

In this example, and referring to FIGS. 1 and 2, in the stowed position, the longitudinal axis LA is parallel to the base axis BA, while referring to FIGS. 3 and 4, in the deployed position longitudinal axis LA is orthogonal to the base axis BA. Furthermore, in this example, the pivot axis PA is orthogonal to the base axis. BA, and pivot axis PA is also orthogonal to the longitudinal axis LA.

Furthermore, in operation of the mast system 100, particularly when installed in the underwater vehicle 600, the longitudinal axis LA is vertical when the mast arm 300 is in the deployed position, and the longitudinal axis LA is horizontal when the mast arm 300 is in the stowed position.

In this example, the mast system 100 can also accommodate a plurality of cables, for example electrical cables and/or fiber optic cables, for providing power transmission and/or data transmission between payload bay 400 and an outside of the mast system 100, for example the underwater vehicle 600. For example, such cables can routed through a center of mast arm 300.

Thus, optionally, the mast system 100 can be provided with a cable management system (not shown), configured for enabling such cables to remain anchored to the payload bay 400 irrespective of whether said mast arm 300 is in the stowed position or in the deployed position, and irrespective of whether the mast arm 300 is in said retracted configuration or in the extended configuration. For example, such a cable management system can be comprised in the support base 200.

The mast system 100 comprises first drive unit 510 for selectively extending and retracting the mast arm 300, and a second drive system 530 for selectively stowing and deploying the mast arm 300.

Referring in particular to FIG. 7, the first drive unit 510 is configured for selectively extending the mast arm 300 to the extended configuration, and for selectively retracting the mast arm to the retracted configuration. Thus, the drive unit 510 operates to selectively drive the mast end 310 longitudinally away from the mast mounting 320 to provide said extended configuration, and to selectively drive the mast end 310 longitudinally towards the mast mounting portion 320 to provide the retracted configuration.

In this example, the first drive unit 510 comprises a chain 512 (which in alternative variations of this example, can be replaced with a cable or the like) which passes around a pulley sprocket 514 that is driven by a motor 516, such as an electric motor for example. The chain 512 is fixedly connected to the outermost telescopic section 350A closest to the mast end 310, and in this example the chain 512 is in the form of an endless loop. In operation of the first drive unit 510 to selectively extend the mast arm 300 to the extended configuration, the motor 516 turns the pulley sprocket 514 in one direction, and the chain 512 is moved to urge the outermost telescopic section 350A outwards, away from the mast mounting portion 320. Conversely, operation of the first drive unit 510 to selectively retract the mast arm 300 to the retracted configuration, the motor 516 turns the pulley sprocket 514 in the opposite direction, and the chain 512 is moved to urge the outermost telescopic section 350A inwards, towards the mast mounting portion 320, so that the telescopic sections are urged to telescope within each other. Referring also to FIG. 2, a drive housing 519 is provided to house at least parts of the drive unit 510, and in particular comprises an extended housing portion 518 for accommodating changes in length of the chain 512 as the arm is extended between the extended configuration and the retracted configuration.

Referring to FIGS. 2 and 3 in particular, the second drive unit 520 is configured for selectively pivoting the mast arm 300 about the pivot axis PA from the stowed position to the deployed position, and for selectively pivoting the mast arm 300 about the pivot axis PA from the deployed position to the stowed position.

In this example, and referring to FIGS. 2 and 3, the second drive unit 520 comprises an extendible configured for providing a linear force as the jack is extended or retracted. The jack 522 includes an inner rod 521 (pivotably mounted to the mast arm 300) reciprocally mounted to an outer cylinder 523 (pivotably mounted to the support base 200). The inner rod 521 can be extended or retracted with respect to the outer cylinder in many different ways, for example electrically or hydraulically, and optionally can employ a screw thread.

While in this example the first drive unit 510 and the second drive unit 520 can each be operated independently of one another, in practice operation of the two drive units can be, and is, linked. In alternative variations of this example, the two drive units are incorporated into a single drive unit which operates in a manner corresponding to such operational linkage.

In any case, for example, such operational linkage can be useful in avoiding potentially damaging the mast system 100. For example, such linking includes not permitting the first drive unit 510 to extend the mast arm 300 from the retracted configuration when the mast arm 300 is in the stowed position, and not permitting the second drive unit 520 to pivot the mast arm 300 to the stowed position when the mast arm 300 is in the extended configuration.

Thus, in the stowed position, the mast arm 300 is constrained to be in the retracted configuration, while in the deployed position the mast arm 300 is selectively deployable to the extended configuration, and selectively retractable to the retracted configuration.

For example, such operational linking can be useful in providing full deployment or full stowage of the mast system 100 in a rapid manner such a feature can be useful, for example, when it is desired to limit the exposure time of the payload bay 400 above the water surface WS, or when an emergency situation requires the mast system 100 to be brought into fill stowage quickly. Such operational linking can include operating the two drive units in rapid succession in order to switch between the full stowage of the mast system 100, comprising the retracted configuration in the stowed position illustrated in FIG. 1, and the full deployment of the mast system 100, comprising the extended configuration in the deployed position illustrated in FIG. 4. Thus, for providing full deployment starting with the mast system 100 fully stowed (FIG. 1), the second drive unit 520 is first operated to pivot the mast arm 300 to the deployed position from stowed position, while the mast arm 300 is in the retracted configuration (FIG. 2); once the deployed position is attained, the second drive unit 520 ceases operation, and the first drive unit 510 is automatically operated to extend the mast arm 300 to the extended configuration (FIG. 4).

Conversely, for providing full stowage starting with the mast system 100 fully deployed (FIG. 4), the first drive unit 510 is first operated to retract the mast arm 300 to the retracted configuration (FIG. 3); once the retracted configuration is attained, the first drive unit 510 ceases operation, and the second drive unit 520 is then automatically operated to pivot the mast arm 300 to the stowed position from deployed position, while the mast arm 300 is in the retracted configuration (FIG. 2).

Another safety feature can include linking operation of the two drive units to operation of the hull doors 609, in particular the powered hull door drive mechanism 620. For example sensors can be provided that sense whether the hull doors 609 are fully open or fully closed. These sensors can be operatively linked to the first drive unit 510 and the second drive unit 520 (for example via a control computer in the vehicle 600 or comprised in the mast system 100), and operation of the two drive units to provide full deployment is not permitted when the sensors indicate that the hull doors 609 are not fully open. Similarly, powered operation of the hull doors (to selectively open or to selectively close the hull doors 609) via the powered hull door drive mechanism 620 can also be linked to operation of the mast system 100, and thus the hull doors can be prevented from closing when the mast system 100 is not fully stowed.

In this example, the mast system 100 is configured for providing feedback regarding whether the mast arm 300 is in the retracted configuration or in the extended configuration. For example, suitable sensors can be provided that provide sensor outputs that indicate whether the mast arm 300 is fully extended in the extended configuration or fully retracted in the retracted configuration. Such sensors can be operatively connected to one or both of the drive units 510, 520, and/or to the operating mechanism of the hull doors 609, for example, directly or via a control computer in the vehicle 600 or comprised in the mast system 100.

In this example, the mast system 100 is also configured for providing feedback regarding whether the mast arm is in the stowed position or in the deployed position. For example, the first angular stop 242 and the second angular stop 244 can each comprise a respective contact sensor, that senses when the mast arm 300 is in contact therewith, and sensor outputs from these sensors can therefore indicate when the mast arm is in the stowed position or in the deployed position. Such sensors can be operatively connected to one or both of the drive units 510, 520, and/or to the operating mechanism of the hull doors 609, for example, directly or via a control computer in the vehicle 600 or comprised in the mast system 100.

As mentioned above, in this example, and referring to FIGS. 1 to 4, the mast system 100 is configured for selectively retracting and selectively extracting the payload bay 400 with respect to a pressure vessel 490, such that when retracted therein, the payload bay 400 is pressure-isolated for the outside of the mast system, in particular from the environment outside of the pressure vessel 490.

Thus, the mast system 100 comprises a pressurisable pressure vessel 490. The pressure vessel 490 comprises a selectively closable and sealable payload housing 480, wherein payload bay 400 is selectively reversibly retractable with respect to the payload housing 480. Thus, the payload bay 400 is selectively retractable into the payload housing 480 to provide a housed configuration, and the payload bay 400 is selectively extractable from the payload housing 480 to provide an exposed configuration. In this example, in the housed configuration, the pressure vessel 490 prevents fluid communication and/or pressure communication between the payload bay 400 and an outside of the mast system 100, in particular the marine environment.

As best seen in FIG. 4, and FIG. 7, the pressure vessel 490 also comprises a bulkhead arrangement 440, provided with the payload bay 400. The payload housing 480 is configured for sealing with respect to this bulkhead arrangement 440 to prevent fluid communication and/or pressure communication between the payload bay 400 and an outside of the mast system 100. On the other hand, in the exposed configuration the payload housing 480 is configured for being unsealed with respect to the bulkhead arrangement 440, and to provide fluid communication and/or pressure communication between the payload bay 400 and the outside of the mast system 100.

In this example, the bulkhead arrangement 440 comprises an outer-facing bulkhead 442 at an outer longitudinal end of the payload bay 400. The bulkhead 442 is configured for preventing fluid communication between the payload bay 400 and an outside of the mast system 100 in a longitudinal outward direction D1 through the bulkhead 440. The bulkhead 442 further comprises a bulkhead sealing perimeter 443 configured for sealing with respect to the payload housing 480 in the housed configuration. In this example, the bulkhead sealing perimeter 443 is in the form of a sealing surface on or near the other edge 449 of the bulkhead 442.

Referring to FIGS. 4, 7 and 7(*a*) in particular, the payload housing 480 comprises a chamber 485 configured for accommodating therein the payload bay 400 when in the housed configuration. The chamber 485 has a chamber opening 486, configured to allow the payload bay 400 to be selectively retracted into and to be selectively extracted from the payload housing 480, and the opening comprises a housing sealing perimeter 488 for sealing with respect to the bulkhead sealing perimeter 443, in said housed configuration.

In this example, the payload housing 480 is fixedly mounted to the mast mounting portion 320, while the bulkhead 442 is fixedly mounted to the payload bay 400. Thus the payload housing 480 is pivotably movable with the mast mounting portion 320 about the pivot axis PA as the mast arm 300 is pivoted between the stowed position and the deployed position. Furthermore, the payload housing 480 remains fixed with the mast mounting portion 320, whether the mast arm 300 is in the extended configuration or in the retracted configuration. On the other hand the bulkhead 442 is brought into alignment with the payload housing 400 in the retracted configuration, and the bulkhead 442 is longitudinally spaced from the payload housing 400 in the extended configuration.

Thus, the payload bay 400 is in the housed configuration concurrent with the mast arm 300 being in the retracted configuration, and, the payload bay 400 is in the exposed configuration at least concurrent with the mast arm 300 being in the extended configuration.

In this example, the bulkhead 442 is generally disc-shaped, and the payload housing 480 comprises a lateral peripheral wall in the form of tubular wall 481 having a payload housing axis parallel to the longitudinal axis LA. The tubular wall 481 defines the chamber opening 486 at one longitudinal end of the tubular wall 481, and has a closed end 483 at the opposite longitudinal end of the tubular wall 481.

In this example, and referring in particular to FIG. 7(*a*), an inflatable seal arrangement 470 is provided, configured for selectively sealing and for selectively unsealing the bulkhead 442 with respect to the payload housing 480 when aligned therewith in the retracted configuration. The inflatable seal arrangement 470 comprises a selectively inflatable and deflatable annular seal body 472, accommodated in and fixed to an annular recess 473 provided near the opening 486. The seal body 472 comprises a seal lumen 477, in fluid communication with a hydraulic system 499 that is configured for selectively providing a desired hydraulic pressure to the seal lumen sufficient for inflating the seal body 472, and for selectively relieving hydraulic pressure at the seal lumen sufficient for deflating the seal body 472.

The seal body 472 has an outer facing seal face 475 that provides the housing sealing perimeter 488. When the seal body 472 is in the inflated state, the seal face 475 is configured to press against the bulkhead sealing perimeter 443, thereby sealing the chamber 485 from the outside of the mast system 100, in particular from the outside of the pressure vessel 490.

Sealing of the pressure vessel 490 occurs at the retracted configuration, and is carried out as follows. With the mast arm 300 in the retracted configuration, the bulkhead 442 is aligned with the payload housing 480 so that the payload bay is in the housed configuration. At this point, the seal face 475 is also aligned with the bulkhead sealing perimeter 443, but a small gap G is provided therebetween to facilitate this alignment. When aligned, the hydraulic system 499 provides hydraulic pressure to the seal lumen 477, inflating the seal body 472, and causing the seal face 475 to press against the bulkhead sealing perimeter 443 and thus close the gap G, thereby sealing the chamber 485 from the outside of the mast system 100, in particular from the outside of the pressure vessel 490. Hydraulic pressure can be maintained via valve 498. For unsealing the pressure vessel 490, a reverse procedure is applied: the hydraulic system 499 relieves hydraulic pressure of the seal lumen 477, deflating the seal body 472, and causing the seal face 475 come away from the bulkhead sealing perimeter 443, thereby reopening the gap G and unsealing the chamber 485.

The pressure vessel 490, when in the housed configuration and sealed, provides a payload bay pressure to the payload bay 400 that is isolated from an outside of the mast system. Essentially, the payload housing 480, when closed with the bulkhead 442, operates as a pressurized vessel with respect to the payload bay 400 for isolating the payload bay pressure from an outside of the mast system 100, in the housed configuration.

By isolating the payload bay pressure from the ambient pressure of an outside of the mast system 100, it is possible to provide and maintain the payload bay pressure at below a threshold value, even where the ambient pressure outside of the pressure vessel 490 is much greater and/or is variable. For example, such a threshold value can be a gauge pressure of 1 bar or less, even while the outside of mast system 100, in particular of the pressure vessel 490, is subject to a gauge pressure of for example 5 bar or more.

By isolating the payload bay pressure from the outside ambient pressure, in particular the outside marine ambient pressure, it is possible to protect the payload that is accommodated within the payload bay 400 from adverse effects of high pressure applied by the outside marine environment ME. It is therefore only necessary to ensure that the payload is capable of withstanding the relatively modest pressure defined by the above mentioned threshold value. This feature of payload bay pressure isolation can be of particular use where the payload only requires to be exposed to the atmospheric environment AT in the exposed configuration of the payload bay 400, and where there is no need to expose the payload to marine conditions consistent with a pressure greater than the threshold value. This is particular more so the case where the payload would be damaged if exposed to pressures greater than the threshold value, and would otherwise require each item of the payload to be protected against exposure to such marine conditions.

Referring again to FIG. 8, when the mast system 100 is fully stowed, i.e., with the mast arm 300 in the retracted configuration and in the stowed position, the mast system 100 fits into a predetermined geometrical envelope GE. This geometrical envelope GE is such as to enable the mast system 100 to be fitted within the hull compartment 603 of the underwater vessel 600, without affecting the drag characteristics of the underwater vehicle 600. For example, the geometrical envelope GE conforms to, or is configured for being mounted within, the hull compartment 609 of an underwater vehicle 600.

Thus, for example, when installed in the underwater vehicle 600, the mast system 100 is configured to optimize performance of the underwater vehicle when the mast arm is fully stowed, and for minimizing exposure of the vessel when the mast arm is fully deployed.

When the mast system 100 is fully deployed, with the mast arm 300 in the extended configuration and in the deployed position, the payload bay 400 extends from the geometrical envelope GE by for example more than 2 m, for example at least up to 3 m or more.

For example the mast system 300 is configured such the mast system 100 is fully deployed, with the mast arm 300 in the extended configuration and in the deployed position, the mast system 100 comprises a center of gravity that is below the centerline CL of the underwater vehicle 600.

The mast system 100 can be used as follows, for example, for exposing a payload (carried by the payload bay 400 and/or the auxiliary payload bay 450) to atmospheric environment while a majority of the remainder of the mast system 100 remains submerged together with the underwater vehicle 600.

First the underwater vehicle 100 transports the desired payload, accommodated in the payload bay 400 and/or the auxiliary payload bay 450, to a desired location. At least a part of this transportation can occur with the underwater vehicle 600 submerged, at any desired depth, for example more than 50 m, which can minimize risk of detection of the underwater vessel 600, for example.

It is to be noted that in order to isolate the payload bay pressure from the marine environment pressure, particularly at such depths, and to maintain constant the payload bay pressure, a pressurization procedure is first conducted for the payload bay, typically at the start of a mission, or at least well before it is intended to submerge the vehicle 600 at pressure greater than the threshold value.

In the pressurization procedure, the pressure vessel 490 is unsealed, with the mast arm 300 in the deployed position and at least partially extended from the retracted configuration, such that the payload housing is at a water depth providing a water pressure corresponding to the threshold value or less. Under these conditions the payload housing is filled with water at this pressure, and the mast arm is then returned to the retracted configuration and stowed position, in which the payload bay 400 is in the housed configuration within the payload housing 480 and the opening 486 is closed by the bulkhead 442. Then the pressure vessel 490 is sealed by the inflatable seal system 470, trapping therein water at a water pressure corresponding to the threshold value or less. In this manner, the payload in the payload bay is exposed to this pressure within the pressure vessel 490. Thereafter, until the pressure vessel is unsealed, the pressure within the pressure vessel 490 remains constant, irrespective of the depth of the underwater vehicle 600, at least for a range of depths over 50 m.

When the underwater vessel 600 is at the required location for the aforementioned atmospheric exposure of the payload, the underwater vehicle 600 attains a water depth corresponding at least to the pressure in the pressure vessel, i.e., at or less than the threshold value. For example such a depth can be about 2 m. The hull doors 609 are opened, and the mast arm 300 is pivoted to the deployed position, and this is followed by unsealing of the pressure vessel 490 and extension of the mast arm to the extended configuration of FIG. 4. For example, for an axial length of the mast arm 300 including the payload bay 400 and cap 455 of about 3 m or 4 m, for example, the top 1 m or 2 m thereof including the payload bay 400 and dome 455 are above the water surface WS. At this point, the payload in the payload bay 400 is exposed to the atmospheric environment.

When it is desired to terminate such exposure, the reverse procedure is implemented, whereupon the mast arm 300 is retracted to the retracted configuration under the water surface at this depth, and the payload bay 400 sealed within the pressure vessel 490 at a pressure corresponding to this depth. The mast arm 300 is then pivoted to the stowed configuration and the hull doors closed. The underwater vehicle can then travel to a different location.

In the method claims that follow, alphanumeric characters and Roman numerals used to designate claim steps are provided for convenience only and do not imply any particular order of performing the steps.

Finally, it should be noted that the word "comprising" as used throughout the appended claims is to be interpreted to mean "including but not limited to".

While there has been shown and disclosed examples in accordance with the presently disclosed subject matter, it will be appreciated that many changes may be made therein without departing from the spirit of the presently disclosed subject matter.

The invention claimed is:

1. A mast system for use with an underwater vehicle, comprising:

a support base defining a base axis;

a mast arm defining a longitudinal axis, and comprising a free longitudinal mast end and a mast mounting portion longitudinally spaced from said mast end;

a payload bay provided at said mast end, configured for supporting a payload therein;

a pressure vessel comprising a payload housing fixedly mounted to said mast mounting portion, the payload housing including a chamber with a chamber opening configured to allow the payload bay to be selectively retracted into and selectively extracted from the payload housing;

the mast arm being mounted to the support base via said mast mounting portion, and the mast arm being selectively deployable with respect to the support base at least between a retracted configuration, in which said mast end is at a first spacing with respect to said mast mounting portion, and an extended configuration, in which said mast end is at a second spacing with respect to said mast mounting portion, wherein said second spacing is greater than said first spacing, wherein the pressure vessel prevents fluid communication and pressure communication between the payload bay and an outside of the mast system in a housed configuration concurrent with the mast arm being in the retracted configuration, wherein said mast arm is pivotably mounted to said support base about a pivot axis via said mast mounting portion, said pivot axis being orthogonal to said longitudinal axis, wherein said mast arm and said payload housing together are reversibly pivotably movable with respect to said support base about said pivot axis between a stowed position and a deployed position.

2. The mast system according to claim 1, wherein said mast arm comprises a plurality of longitudinally movable nested telescopic sections between said mast end and said mast mounting portion.

3. The mast system according to claim 1, comprising a first drive unit for selectively driving said mast end longitudinally away from said mast mounting to provide said extended configuration, and for selectively driving said mast end longitudinally towards said mast mounting to provide said retracted configuration, and comprising a second drive unit for selectively pivoting said mast arm about said pivot axis from said stowed position to said deployed position, and for selectively pivoting said mast arm about said pivot axis from said deployed position to said stowed position.

4. The mast system according to claim 1, including at least one of the following:

wherein in said stowed position, said mast arm is in said retracted configuration, and wherein in said deployed position said mast arm is selectively deployable to said extended configuration;

wherein in said stowed position, said longitudinal axis is parallel to said base axis, and wherein in said deployed position said longitudinal axis is orthogonal to said base axis; and wherein said pivot axis is orthogonal to said base axis.

5. The mast system according to claim 1, wherein said payload bay is pivotable about said longitudinal axis, at least in said extended configuration.

6. The mast system according to claim 1, wherein said payload bay is configured to be moved between an exposed configuration in which said payload bay is located outside said payload housing, and ft the housed configuration in which said payload bay is received in said payload housing and fluid communication is prevented between said payload bay and the outside of said mast system.

7. The mast system according to claim 6, wherein said pressure vessel comprises a bulkhead arrangement, wherein in said housed configuration said payload housing is configured for sealing with respect to said bulkhead arrangement to prevent fluid communication between said payload bay and an outside of said mast system, and wherein in said exposed configuration said payload housing is configured for being unsealed with respect to said bulkhead arrangement and to provide fluid communication between said payload bay and an outside of said mast system.

8. The mast system according to claim 7, wherein said bulkhead arrangement is fixed to the payload bay.

9. The mast system according to claim 6, wherein said bulkhead arrangement comprises an outer facing bulkhead at an outer longitudinal end of said payload bay, said bulkhead configured for preventing fluid communication between said payload bay and an outside of said mast system in a longitudinal outward direction through said bulkhead, said bulkhead further comprising a bulkhead sealing perimeter configured for sealing with respect to said payload housing in said housed configuration.

10. The mast system according to claim 9, including at least one of the following:

further comprising an auxiliary payload bay projects outwardly from said bulkhead, said auxiliary payload bay being in communication with said payload bay;

wherein said payload housing comprises a chamber configured for accommodating therein said payload bay in said housed configuration, said chamber having a chamber opening configured to allow said payload bay to be selectively and reversibly retracted with respect to said payload housing, said opening comprising a housing sealing perimeter for reversibly sealing with respect to said bulkhead sealing perimeter in said housed configuration;

wherein said payload housing comprises a chamber configured for accommodating therein said payload bay in said housed configuration, said chamber having a chamber opening, said opening comprising a housing sealing perimeter for reversibly sealing with respect to said bulkhead sealing perimeter in said housed configuration, and, wherein said bulkhead is disc-shaped and wherein said payload housing comprises a lateral peripheral wall having a payload housing axis parallel to said longitudinal axis, and defining said chamber opening and a closed end at respective opposite longitudinal ends of said lateral peripheral wall;

wherein said payload housing comprises a chamber configured for accommodating therein said payload bay in said housed configuration, said chamber having a chamber opening configured to allow said payload bay to be selectively and reversibly retracted with respect to said payload housing, said opening comprising a housing sealing perimeter for reversibly sealing with respect to said bulkhead sealing perimeter in said housed configuration, and, wherein said bulkhead is disc-shaped and wherein said payload housing comprises a lateral peripheral wall having a payload housing axis parallel to said longitudinal axis, and defining said chamber opening and a closed end at respective opposite longitudinal ends of said lateral peripheral wall, and, wherein said lateral peripheral wall is a tubular wall; and comprising an inflatable seal arrangement for selectively sealing and for selectively unsealing said bulkhead with respect to said payload housing.

11. The mast system according to claim 6, including at least one of the following:

wherein said pressure vessel maintains said payload bay pressure constant in said housed configuration;

wherein said pressure vessel operates to maintain said payload bay pressure at below a threshold value, in said housed configuration;

wherein said pressure vessel operates to maintain said payload bay pressure at below a threshold value, in said housed configuration, and, wherein said threshold value is a gauge pressure of 1 bar or less;

wherein said pressure vessel operates to maintain said payload bay pressure at below a threshold value, in said housed configuration, and, wherein said threshold value is a gauge pressure of 1 bar or less, while an outside ambient pressure is under a gauge pressure of more than 5 bar;

wherein said payload bay is in said housed configuration concurrent with said mast arm being in said retracted configuration;

wherein said payload bay is in said exposed configuration at least concurrent with said mast arm being in said extended configuration; and wherein said payload housing is fixedly mounted to said mast mounting portion and is pivotably movable with said mast mounting portion about said pivot axis.

12. The mast system according to claim 1, wherein said pressure vessel is configured for enabling the payload bay to have a said payload bay pressure isolated from an outside of said mast system, in said housed configuration.

13. The mast system according to claim 1, including at least one of the following:

wherein said mast arm comprises a lumen;

further comprising a plurality of cables providing at least one of power transmission and data transmission between said payload bay and an outside of said mast system;

further comprising a plurality of cables providing at least one of power transmission and data transmission between said payload bay and an outside of said mast system, and, further comprising a cable management system, configured to enabling the cables to remain anchored to the payload bay irrespective of whether said mast arm is in said stowed position or in said deployed position, and irrespective of whether said mast arm is in said retracted configuration or in said extended configuration;

further comprising a plurality of cables providing at least one of power transmission and data transmission between said payload bay and an outside of said mast system, and, further comprising a cable management system, configured to enabling the cables to remain anchored to the payload bay irrespective of whether said mast arm is in said stowed position or in said deployed position, and irrespective of whether said mast arm is in said retracted configuration or in said extended configuration, and, wherein said cable management system is comprised in said support base;

further comprising a plurality of cables providing at least one of power transmission and data transmission between said payload bay and an outside of said mast system, and, wherein said cables are routed through a center of said mast arm;

wherein in said deployed position, said longitudinal axis is vertical;

wherein in said stowed position, said longitudinal axis is horizontal;

wherein in said retracted configuration and said stowed position, said mast system fits into a predetermined geometrical envelope;

wherein in said retracted configuration and said stowed position, said mast system fits into a predetermined geometrical envelope, and, wherein in said extended configuration and said deployed position, said payload bay extends from said geometrical envelope by more than 2 m or by at least 3 m;

wherein in said retracted configuration and said stowed position, said mast system fits into a predetermined geometrical envelope, and, wherein said geometrical envelope conforms to, or is configured for being mounted within, a hull compartment of an underwater vehicle; and wherein in said retracted configuration and said stowed position, said mast system fits into a predetermined geometrical envelope, and, wherein said geometrical envelope conforms to, or is configured for being mounted within, a hull compartment of an underwater vehicle, and, wherein said mast system in said extended configuration and said deployed position comprises a center of gravity that is below a centerline of the underwater vehicle.

14. An underwater vehicle comprising the mast system as defined in claim 1.

15. The underwater vehicle according to claim 14, wherein said vehicle is an unmanned underwater vehicle.

16. A method for selectively exposing a payload to an atmospheric environment, comprising:

(a) providing a mast system as defined in claim 1;

(b) operating the mast system to deploy the mast arm at least to the extended configuration while a remainder of the mast system is submerged.

17. A mast system for use with an underwater vehicle, comprising:

a support base defining a base axis;

a mast arm defining a longitudinal axis, and comprising a free longitudinal mast end and a mast mounting portion longitudinally spaced from said mast end;

a payload bay provided at said mast end, configured for supporting a payload therein;

a pressure vessel comprising a payload housing fixedly mounted to said mast mounting portion, the payload housing including a chamber with a chamber opening configured to allow the payload bay to be selectively retracted into and selectively extracted from the payload housing;

the mast arm being mounted to the support base via said mast mounting portion, and the mast arm being selectively deployable with respect to the support base between a retracted configuration, in which said mast end is at a first spacing with respect to said mast mounting portion, and an extended configuration, in which said mast end is at a second spacing with respect to said mast mounting portion, wherein said second spacing is greater than said first spacing, wherein said payload bay is selectively reversibly retractable into said pressure vessel to enable isolating a payload bay pressure from an ambient pressure outside of said pressure vessel, wherein said mast arm is pivotably mounted to said support base about a pivot axis via said mast mounting portion, said pivot axis being orthogonal to said longitudinal axis, and wherein said mast arm and said payload housing together are reversibly pivotably movable with respect to said support base about said pivot axis between a stowed position and a deployed position.

18. The mast system according to claim 17, wherein the pressure vessel prevents fluid communication and pressure communication between the payload bay and an outside of the mast system in a housed configuration concurrent with the mast arm being in the retracted configuration.

* * * * *